US011835327B2

(12) United States Patent
Smith et al.

(10) Patent No.: US 11,835,327 B2
(45) **Date of Patent: *Dec. 5, 2023**

(54) ADJUSTABLE CARRIER DEVICE

(71) Applicant: HSG, LLC, Swansboro, NC (US)

(72) Inventors: Darrell Keith Smith, Swansboro, NC (US); Daniel Logan Chaney, Morehead City, NC (US)

(73) Assignee: HSG, LLC, Swansboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/146,129

(22) Filed: Dec. 23, 2022

(65) Prior Publication Data

US 2023/0139336 A1 May 4, 2023

Related U.S. Application Data

(63) Continuation of application No. 17/519,155, filed on Nov. 4, 2021, now Pat. No. 11,536,550.

(51) Int. Cl.
*F42B 39/02* (2006.01)

(52) U.S. Cl.
CPC ..... *F42B 39/02* (2013.01)

(58) Field of Classification Search
CPC ..... A45F 2200/0591; A45F 5/00; A45F 5/02; A45F 5/021; A45F 3/06; F42B 39/02; F41C 33/04; F41C 33/00337; F41C 33/0209; F41C 33/0236
See application file for complete search history.

(56) References Cited

U.S. PATENT DOCUMENTS

| | | | |
|---|---|---|---|
| 900,094 | A | 10/1908 | Fisher |
| 1,940,900 | A | 12/1933 | Barnard |
| 3,053,005 | A | 9/1962 | Byers |
| 3,173,465 | A | 3/1965 | Pastini |
| 3,955,724 | A | 5/1976 | Perkins |

(Continued)

FOREIGN PATENT DOCUMENTS

| | | | |
|---|---|---|---|
| FR | 2642399 | A1 | 8/1990 |
| FR | 2906113 | A1 | 3/2008 |
| WO | 2008098116 | A1 | 8/2008 |

OTHER PUBLICATIONS

"KRYDEX 5.56mm 7.62mm Mag Pouch Softshell Magazine Pouch with Molle Clip." Amazon.com. Accessed Oct. 15, 2020.

(Continued)

*Primary Examiner* — Corey N Skurdal
(74) *Attorney, Agent, or Firm* — NK Patent Law

(57) ABSTRACT

A carrier device includes a body member having two parallel sections, terminal ends of which extend in a common direction. A bracket nested with the body member has two lateral side members extending in the common direction. Each side member has a terminal end and a loop proximate the end defining a hole. An interior is defined between the sections of the body member and between the side members of the bracket. A binding member engages the sections of the body member and passes through the respective hole of each side member defined by the loop. A retention member, for retaining a magazine when inserted into the carrier device, also passes through the respective holes. The binding member draws sections of the body member toward each other to maintain frictional engagement of an inserted magazine or other article with interior contact points of the carrier device.

20 Claims, 14 Drawing Sheets

(56) References Cited

U.S. PATENT DOCUMENTS

| | | | |
|---|---|---|---|
| 4,143,798 | A | 3/1979 | Perkins |
| 4,262,832 | A | 4/1981 | Perkins |
| 4,273,276 | A | 6/1981 | Perkins |
| 4,424,924 | A | 1/1984 | Perkins |
| 4,694,980 | A | 9/1987 | Rogers |
| 4,925,075 | A | 5/1990 | Rogers |
| 5,018,654 | A | 5/1991 | Rogers et al. |
| 5,100,036 | A | 3/1992 | Rogers et al. |
| 5,174,482 | A | 12/1992 | Rogers et al. |
| 5,275,317 | A | 1/1994 | Rogers et al. |
| 5,372,288 | A | 12/1994 | Rogers et al. |
| 5,465,429 | A | 11/1995 | Rogers et al. |
| 5,501,381 | A | 3/1996 | Rogers et al. |
| 5,536,553 | A | 7/1996 | Coppage, Jr. et al. |
| 5,619,748 | A | 4/1997 | Nelson et al. |
| 5,622,297 | A | 4/1997 | Rogers et al. |
| 5,722,576 | A | 3/1998 | Rogers |
| 5,724,670 | A | 3/1998 | Price |
| 5,881,933 | A | 3/1999 | Rogers |
| 5,926,842 | A | 7/1999 | Price et al. |
| 5,931,358 | A | 8/1999 | Rogers |
| 5,944,239 | A | 8/1999 | Rogers et al. |
| 5,997,787 | A | 12/1999 | Nelson et al. |
| 6,010,045 | A | 1/2000 | Rogers et al. |
| 6,202,908 | B1 | 3/2001 | Groover |
| 6,237,820 | B1 | 5/2001 | Saxton |
| D453,068 | S | 1/2002 | Rogers et al. |
| 6,371,341 | B1 | 4/2002 | Clifton, Jr. |
| 6,409,048 | B1 | 6/2002 | Belzeski |
| 6,463,637 | B1 | 10/2002 | Carnahan |
| 6,467,660 | B2 | 10/2002 | Rogers et al. |
| 6,588,640 | B1 | 7/2003 | Rogers et al. |
| 6,634,131 | B1 | 10/2003 | Fitzpatrick |
| 6,662,986 | B2 | 12/2003 | Lehtonen |
| 6,769,581 | B2 | 8/2004 | Rogers et al. |
| 6,945,399 | B1 | 9/2005 | Ong |
| 7,314,152 | B1 | 1/2008 | Garrett |
| 7,694,860 | B2 | 4/2010 | Clifton, Jr. |
| 7,845,527 | B1 | 12/2010 | McMillan et al. |
| 7,918,371 | B2 | 4/2011 | Wilson |
| 8,231,038 | B2 | 7/2012 | Felts |
| 8,485,405 | B2 | 7/2013 | Crye |
| 8,584,917 | B2 | 11/2013 | Hexels |
| 9,394,080 | B2 | 7/2016 | Beck |
| 9,668,568 | B2 | 6/2017 | Evans |
| 9,759,536 | B2 | 9/2017 | Gadams et al. |
| 9,795,210 | B2 | 10/2017 | Evans |
| 9,861,184 | B2 | 1/2018 | VanHeusen |
| 10,306,973 | B2 | 6/2019 | Evans et al. |
| 10,537,167 | B2 | 1/2020 | Bryant et al. |
| 10,612,888 | B2 | 4/2020 | Toschi |
| 10,928,172 | B1 | 2/2021 | Mironski |
| 2002/0100780 | A1 | 8/2002 | Rogers et al. |
| 2003/0075575 | A1 | 4/2003 | Rogers et al. |
| 2005/0045681 | A1 | 3/2005 | Hancock et al. |
| 2005/0056643 | A1 | 3/2005 | Hagan et al. |
| 2007/0017947 | A1 | 1/2007 | Fenton et al. |
| 2007/0228099 | A1 | 10/2007 | Beda |
| 2008/0277436 | A1 | 11/2008 | Wilson |
| 2011/0006090 | A1 | 1/2011 | Bollard |
| 2013/0082080 | A1 | 4/2013 | Hellweg |
| 2013/0248566 | A1 | 9/2013 | Solomon |
| 2016/0003598 | A1 | 1/2016 | Gadams et al. |
| 2016/0209163 | A1 | 7/2016 | VanHeusen |
| 2016/0327382 | A1 | 11/2016 | Beck |
| 2019/0365064 | A1 | 12/2019 | Buerck |

OTHER PUBLICATIONS

USPTO; Non-Final Action for U.S. Appl. No. 17/519,155 dated Sep. 9, 2022, 8 pages.

ADJUSTABLE CARRIER DEVICE

CROSS-REFERENCE TO RELATED APPLICATION

This application is a continuation of U.S. non-provisional patent application Ser. No. 17/519,155, titled "ADJUSTABLE CARRIER DEVICE," filed on Nov. 4, 2021, the entire contents of which is hereby incorporated herein by reference.

TECHNICAL FIELD

The present disclosure relates to devices for carrying articles. More particularly, the present disclosure relates to an adjustable carrier device for an ammunition magazine.

BACKGROUND

Ammunition magazine carrying pouches are typically fabric walled and can thus be used to carry various types of articles by conforming somewhat to any inserted article. While such flexibility is useful, in order to secure a carried article, some sort of manually released closure means is needed. For example, a closure flap may overlay the opening of the pouch to secure an enclosed article, with the flap being secured in a closed configuration with a button or hook-and-loop fabric patches. An entirely soft-walled pouch surrounded by a cinching cord may collapse when emptied, and may gather at its opening. Thus typical ammunition carrying pouches may delay access to ammunition or other carried article at a critical moment.

Hard-shell carriers, on the other hand, are typically less flexible as to their use, and may be sized and shaped for a specific article type. While a hard-shell carrier having fixed dimensions such as a box may not collapse when empty, a manually released closure means may be needed as with a soft-walled pouch. Thus, again, access to a needed article such as an ammunition magazine may be delayed at a critical moment as the closure is manually released.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

In at least one embodiment, a carrier device includes: a body member including a first section, a second section parallel to the first section, and a central section to which the first section and second section are attached, the first section and second section each having a terminal end, the terminal end of the first section and the terminal end of the second section extending away from the central section in a common direction. A bracket includes a central base plate, a first lateral side member attached to a first end of central base plate, and a second lateral side member attached to a second end of central base plate, the first lateral side member and second lateral side member each having a respective terminal end and a respective loop proximate the respective terminal end defining a respective hole, the terminal end of the first lateral side member and the terminal end of the second lateral side member extending away from the base plate in the common direction, wherein the bracket is nested with the body member with the base plate proximate the central section such that an interior of the carrier device is defined between the first section and second section of the body member and between the first lateral side member and second lateral side member. A binding member engages the first section and the second section, the binding member passing through each said respective hole defined by said respective loop of the first lateral side member and second lateral side member of the frame. A retention member, for retaining a magazine when inserted into the carrier device, has a respective portion passing through each said respective hole defined by said respective loop of the first lateral side member and second lateral side member of the frame.

The terminal ends of the lateral side members may extend in the common direction beyond the terminal ends of the first section and second section of the body member.

The terminal ends of the lateral side members and the terminal ends of the first section and second section of the body member may together define an opening into the interior of the carrier device.

The respective terminal end of each lateral side member may include a ramped inward contact surface such that the opening into the interior of the carrier device is tapered.

The respective terminal end of each of the first section and second section of the body member may include a ramped inward contact surface.

An upper tip of the loop of each lateral side member may define the terminal end thereof.

An interior face of the loop of each lateral side member may define the ramped inward contact surface thereof.

A laterally outward portion of the loop of each lateral side member may extend generally parallel to the side member thereby defining the hole as an elongate slot.

Each lateral side member, along an exterior side thereof, may include at least one pair of parallel spaced ribs.

A portion of the binding member may be held in a space between the ribs by at least on other portion of the binding member.

The ribs may have alternating high portions and low portions to guide the binding member.

Each lateral side member, along an exterior side thereof, may include multiple pairs of parallel spaced ribs, wherein each pairs is spaced from at least one other by a gap that receives a respective portion of the binder member.

The body member may be a unitary materially contiguous item of which the first section, second section and central section are materially contiguous portions.

The body member may include polymer.

The first section of the body member may include hooks for releasably engaging the binding member.

The second section of the body member may include hooks for releasably engaging the binding member.

The body member may include a flexible and foldable rectangular assembly comprising fabric.

The body member may include multiple band portions attached to the first section defining loops to engage respective portions of the binding member.

The body member may include bands attached to the second section to engage respective portions of the binding member.

The binding member may include a stretchable cord having an adjustable loop portion and an adjuster.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1A:
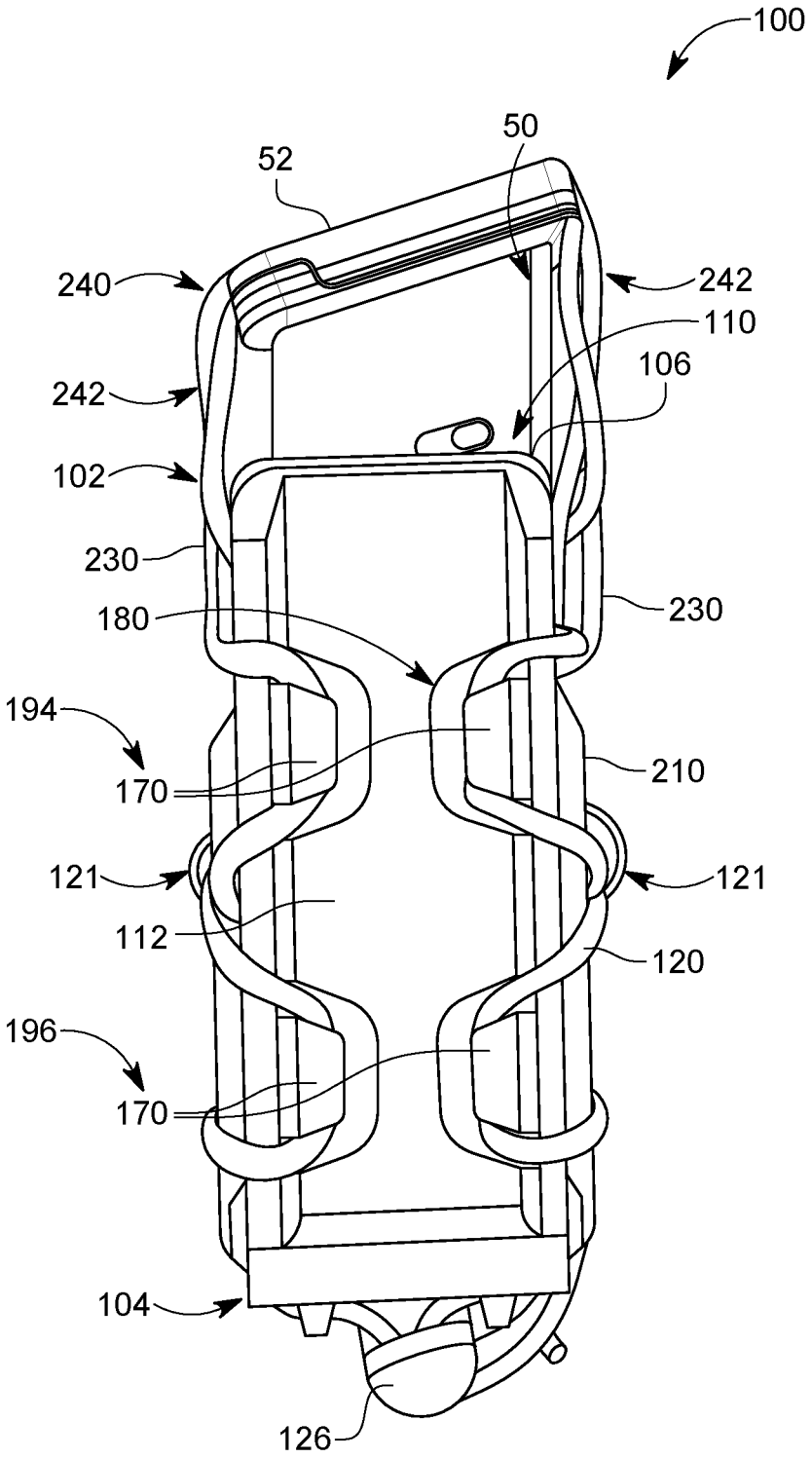
FIG. 1A is a front view of a carrier device, according to at least one embodiment, shown carrying a magazine, for example for a pistol.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

A carrier device 100 according to at least one embodiment is shown in FIG. 1A with an ammunition magazine 50 inserted and retained by the device. Magazines are available in a variety of sizes and configurations for many types of ammunition and firearms. The carrier device 100 accordingly can vary in particular dimensions. The magazine 50 particularly shown in FIG. 1A is for ammunition typically used in a semiautomatic handgun, and thus the carrier device 100 of FIG. 1A can be described as suited for use with a pistol without limitation as to other uses.

In use as shown in FIG. 1A, a magazine 50 is inserted into an open first end 102 of the device 100. The open first end 102 may be for example oriented as upward in use. However, due to the magazine retention capability of the device, users may prefer various carrying strategies in which other orientations are utilized. A second end 104 of the device, opposite the first end, is generally closed with regard to insertion or passage of the magazine 50 or other carried articles, such that full insertion of a magazine is registered when the ammunition-feed end of the magazine reaches the of the second end 104 of the device 100. At full insertion, the floor plate end 52 of the magazine extends outward from the first end 102 as available to be grasped and pulled from the carrier device 100. Advantageously ramped inward contact surfaces 106 and 108 define a tapered opening 110 into the interior of the carrier device 100, to receive the magazine 50 or other article, and that narrows to guide the magazine or article to proper alignment and insertion.

A first exterior surface 112 (FIG. 1A) of the carrier device 100 may be generally directed outward when the carrier device is mounted on a host such as a belt, strap, vest, harness, or pack, such as a MOLLE-equipped host item or apparel, referring to Modular Lightweight Load-carrying Equipment (MOLLE) having spaced mounting straps. In such use, a second exterior surface 114 (FIG. 1C), opposite the first exterior surface 112, would be generally directed toward such a host. A mounting strap 56, for example attached to the second exterior surface 114, may be provided as an accessory for attaching the carrier device 100 to a host.

Retention of the magazine 50 by the carrier device 100 against unintended removal, for example as a user or gear on which the device is mounted moves about, is assured by the elastically self-adjusting performance of the carrier device. A binding member 120 is stretched among front, side, and back panels of the device 100 thereby adjustably circumferentially tightening the device around the magazine to maintain frictional engagement of an inserted magazine with interior contact points of the carrier device. This frictionally secures an inserted magazine while permitting sliding entry and removal of the magazine by force applied by hand at the outward extending end of the magazine, such as the floor plate end 52 of the magazine.

Figure 2C:
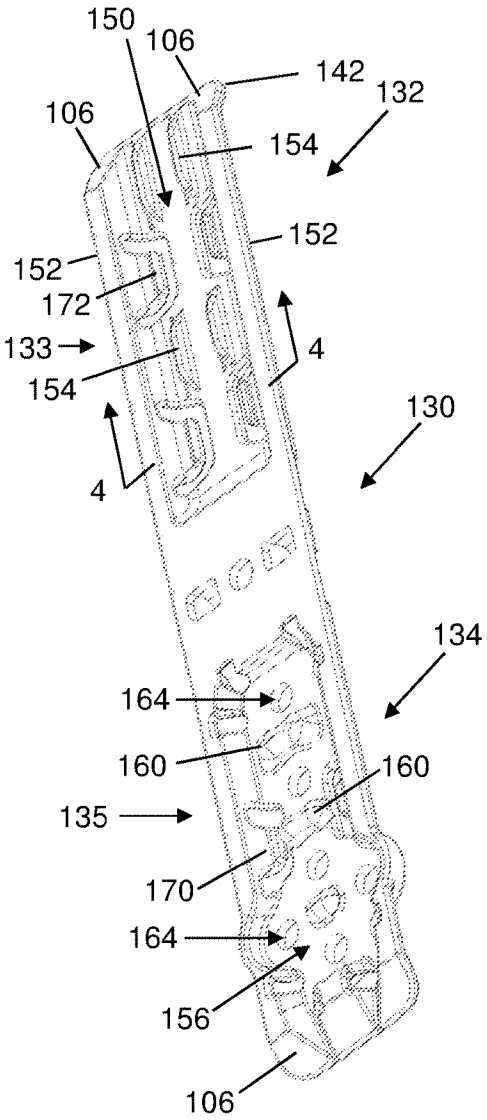
FIG. 2C shows the inward side of the body member of FIG. 2A in perspective view.
Figure 2B:
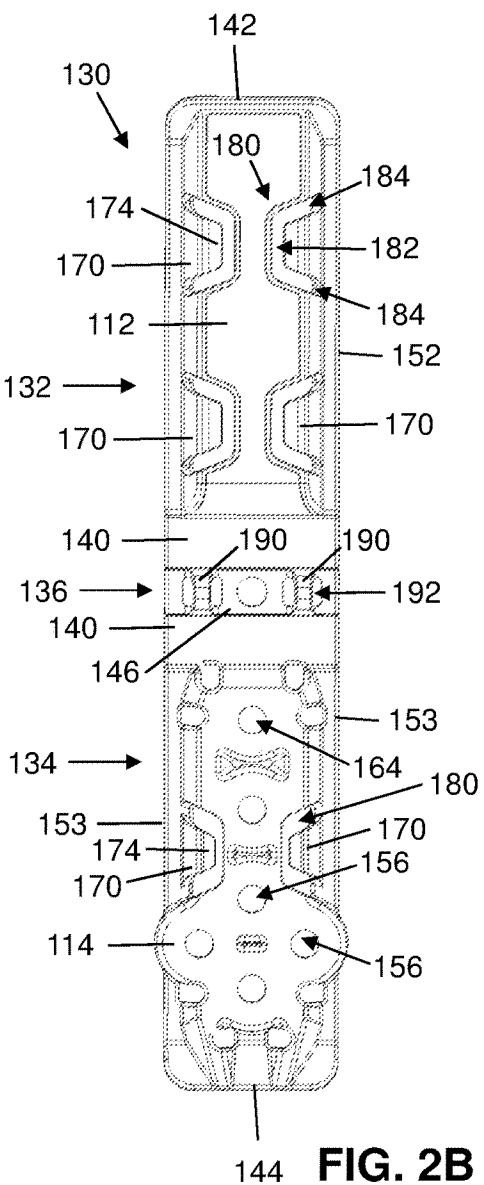
FIG. 2B shows the outward side of the body member of FIG. 2A in plan view.
Figure 2A:
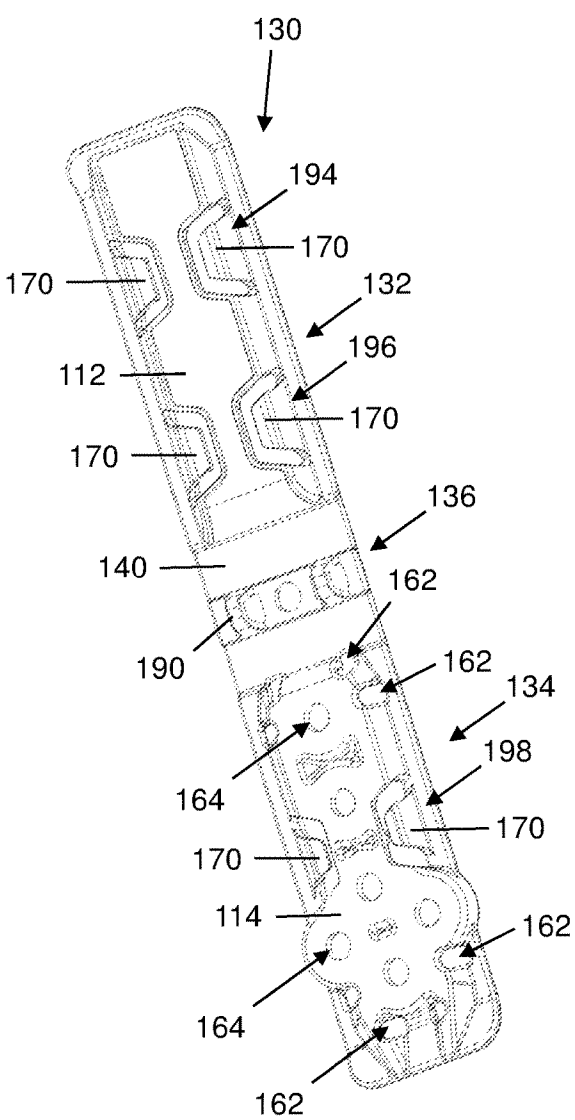
FIG. 2A shows the outward side of an unfolded body member of the device of FIG. 1 in perspective view.

The first exterior surface 112 and opposite second exterior surface 114 of the carrier device 100 in the illustrated embodiment are defined by the outer surfaces of corresponding sections of a unitary materially contiguous body member 130 (FIGS. 2A-2C) when folded as in the assembled device 100 (FIG. 1A). A first section of the body member 130 defines a front or first panel 132 of the assembled carrier device 100, and a second section of the body member 130 defines a back or second panel 134 of the assembled carrier device 100. Front and back are nominal terms referring to some expected uses of the carrier device 100 without limiting the carrier device 100 in its construction or use.

The first panel 132 and second panel 134 are each attached to a central base section 136 (FIG. 2B) of the body member 130. The first panel 132 extends from a flexible first strip portion 140 of the base section 136 to a first terminal end 142 of the body member 130. The second panel 134 extends from a flexible second strip portion 140 of the base section 136 to a second terminal end 144 of the body member 130. The terminal ends 142,144 (FIG. 2B) extend in opposite directions from the base section 136 in the unfolded condition. When the first panel 132 and second panel 134 are folded into approximately parallel condition as in the assembled carrier device 100 (FIG. 1A), the terminal ends 142,144 extend in a common longitudinal direction and define, in cooperation with the bracket 200 as described below, the first end 102 of the device. The folding of the body member 130 is effected as flexure, at least or particularly, of the flexible strip portions 140, which are connected by a rigidified base plate 146 (FIG. 2B) that defines the second end 104 of the assembled carrier device 100 (FIG. 1A).

Figure 4:
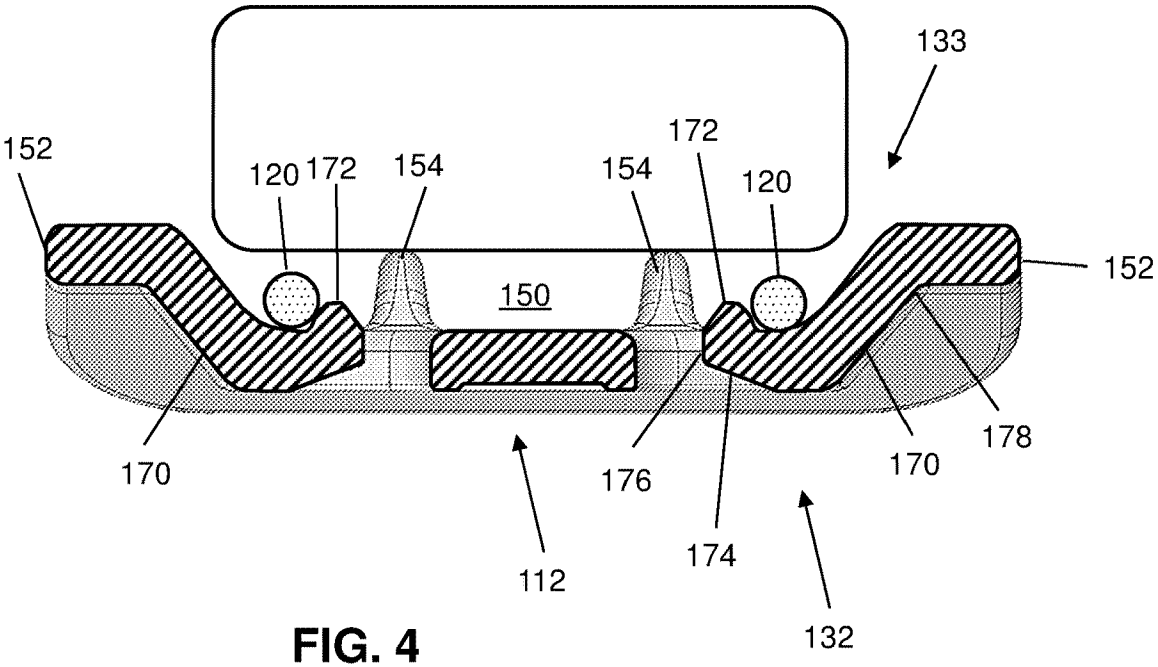
FIG. 4 is a cross-sectional view of the body member taken along the line 4-4 in FIG. 3C.

Contours and operative features of the body member 130 rigidify the first panel 132, second panel 134, and base plate 146. For example, with reference to rigidifying contours of the body member 130, the inward side 133 of the first panel 132 has an inside channel 150 (FIG. 2C), extending longitudinally from the first terminal end 142 to the first strip portion 140 of the base section 136, defined between lateral edges 152 of the first panel 132. Longitudinal ridges 154 extend inward in laterally spaced pairs from the inward side 133 of the first panel 132 further add rigidity and provide frictional engagement with a magazine 50 or other article within the carrier as represented in FIG. 4.

The inward side 135 (FIG. 2C) of the second panel 134, which faces the inward side 133 of the first panel 132 in the assembled carrier device, has an inside recess 156 defined between its lateral edges 153, and several inward extending bosses 160 to provide further frictional engagement with a magazine or other article on an opposite side of the article relative to the ridges of the first panel 132. Multiple holes 162 (FIG. 2A) for passage and retention of the binding member 120 are defined through the second panel 134 along the periphery of the recess 156. Mounting holes 164 for receiving fasteners such as screws are defined through outwardly planar portions of the second panel 134 opposite the recess 156. The arrangement pattern of the holes 164 matches hole patterns in accessories such as the mounting strap 56 attached to the second panel 134 in FIG. 1C by fasteners 58.

Along each lateral edge 152, the first panel 132 has laterally inwardly directed hooks 170 defined by slots 180 formed through the first panel. Each hook 170, at an end 176 thereof, has an inwardly extending tooth 172 (FIG. 4) that retains a portion of the binding member 120 in the assembled carrier device 100. An angled face 174 of the hook 170, at the end 176 and opposite the tooth 172, is angled inward away from the first exterior surface 112. The end 176 of the hook 170 is thereby sunken relative to the first exterior surface 112 to protect the end of the hook from snagging on other objects. The angled face 174 is particularly advantageous in that, even if tension in the binding member 120 flexes the hook somewhat, the angled face 174 assures the end 176 of the hook remains sunken, approaches a flush disposition with the first exterior surface 112, or is minimally exposed to any likelihood of snagging other objects. Each slot 180 is approximately U-shaped, having a longitudinally extending linear central slot portion 182 (FIG. 2B), and a respective angled slot portion 184 at each end of the central slot portion, thereby defining an approximately trapezoidal hook 170 that has a base 178 (FIG. 4) connected to a corresponding lateral edge 152 and tapers therefrom to the end 176 of the hook. The hook 170, from the base 178 to the verge of the angled face 174 is flush with the contours of the first exterior surface 112.

Along each lateral edge 153 thereof, the second panel 134 has a respective laterally inwardly directed hook 170 defined by slots 180 similarly as for the hooks 170 of the first panel 132. Each hook 170 of the second panel 134, however, in the illustrated embodiment does not have a tooth. The hook 170 retains a portion of the binding member 120 in the assembled carrier device 100, and an angled face 174 of the hook opposite the tooth by which the end 176 of the hook is thereby sunken relative to the second exterior surface 114. Each hook 170 is approximately trapezoidal, having a base 178 connected to a corresponding lateral edge 153 and tapering trapezoidally therefrom to the end 176 of the hook 170.

A laterally spaced pair of tabs 190 (FIG. 2B) extend outward from the outward side of the base section 136 of the body member 130. Each tab 190 has a laterally extending hole 192 for passage and retention of the binding member 120. In the binding arrangement of the drawings, the adjuster 126 is nestled between the tabs when the binding member 120 is drawn taut.

In the illustrated embodiments, the first panel 132 has an opposing first pair 194 of hooks proximal the first end 102 (FIG. 1A, FIG. 2A) and an opposing second pair 196 of hooks 170 proximal the second end 104 longitudinally spaced from the first pair 194. The second panel 134 has an opposing pair of hooks 170, referenced as the third pair 198 (FIG. 2A) rearwardly offset from, and longitudinally positioned between, the first pair 194 and second pair 196 in the assembled carrier device 100. By such placement of the pairs, the binding member 120 can be engaged in ordered succession such as the first pair 194, the third pair 198, and the second pair 196 along each lateral side of the carrier device 100 as in the illustrated binding arrangement.

Figure 5:
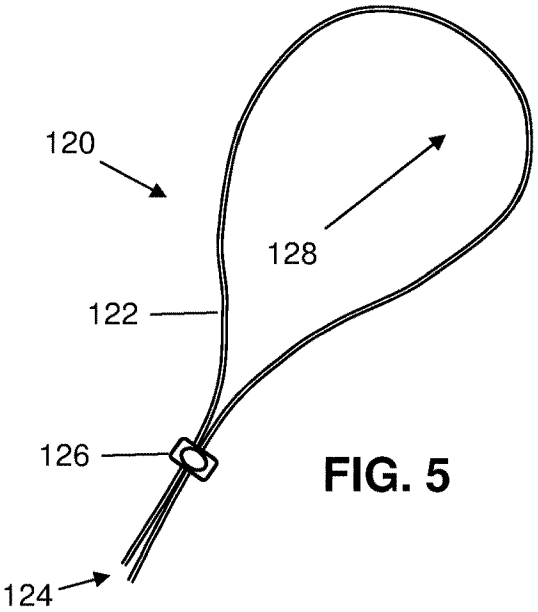
FIG. 5 shows a binding member and adjuster thereof separated from the device of FIG. 1.

The binding member 120 is illustrated (FIG. 5) as a stretchable cord 122 having one or more elastic strands forming a core covered in a woven fibrous sheath, for example made of polypropylene. Such binding members are known, for example, as shock cords and bungee cords. Opposite free ends 124 of the binding member extend from an adjuster 126 to define an adjustable loop portion 128 (FIG. 5) of the binding member. The adjuster 126 is shown as a cord lock in the drawings. The adjustable loop portion 128 of the binding member 120 urges the interior of carrier device 100 upon a magazine or other carried article to maintain frictional engagement.

Opposite lateral side members of the assembled carrier device 100 (FIG. 1A) are provided by the bracket 200 shown in various views in FIGS. 3A-3D. The bracket 200 includes a central base plate 202 and, attached to opposite respective lateral ends of the base plate, a first lateral side member 204 and a second lateral side member 204 that extend parallel to each other in a common longitudinal direction from the base plate. In the assembled carrier device 100, the bracket 200 is nested within the body member 130 in the folded condition, with the exterior side of the base plate 202 of the bracket 200 abutting or proximate the interior side of the base plate 146 of the body member 130.

Respective terminal ends 206 of the side members 204, in cooperation with the terminal ends 142 and 144 of the body member 130, define the first end 102 of the assembled carrier device 100. A respective ramped inward contact surface 108 adjacent the terminal end 206 of each side member 204 of the bracket 200 cooperates with the contact surfaces 106 to define the tapered opening 110 of the assembled carrier device 100.

Figure 3A:
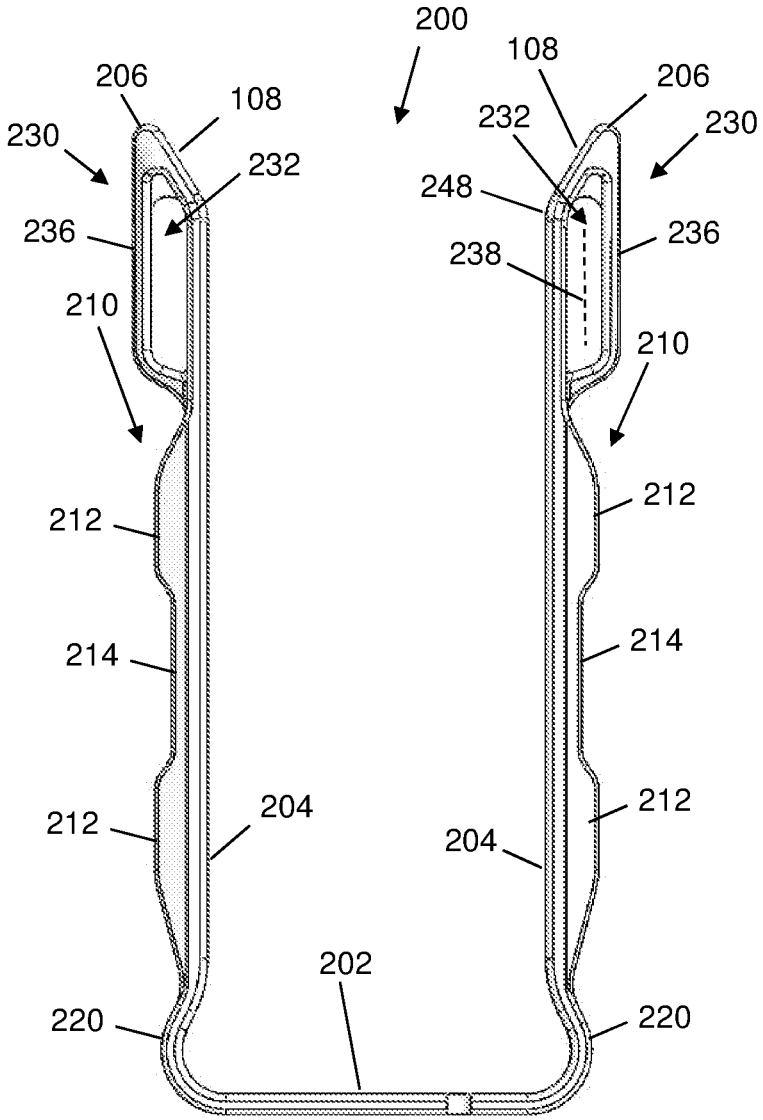
FIG. 3A is a front view of a bracket for the carrier device of FIG. 1.
Figure 3B:
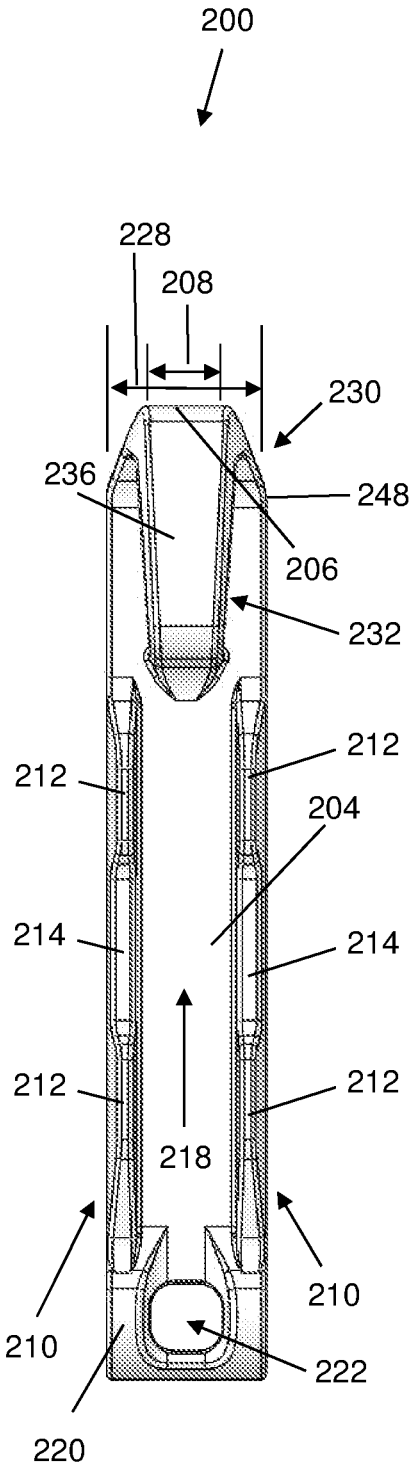
FIG. 3B is a side view of the bracket of FIG. 3A.
Figure 3C:
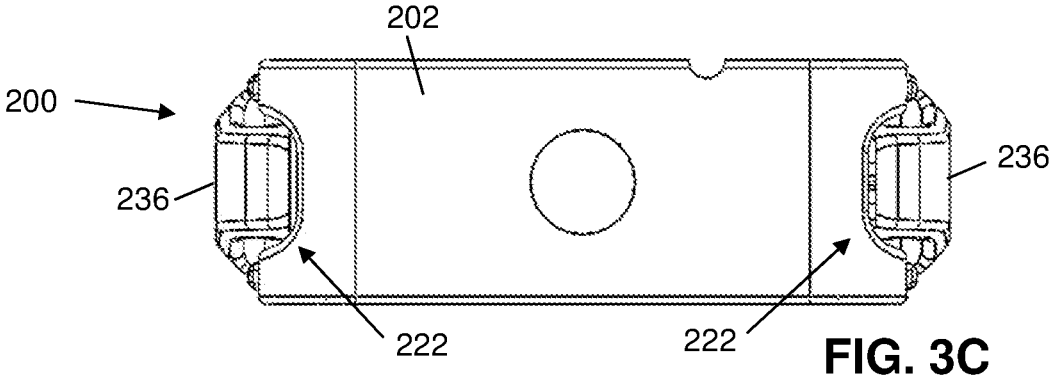
FIG. 3C is a bottom view of the bracket of FIG. 3A.
Figure 3D:
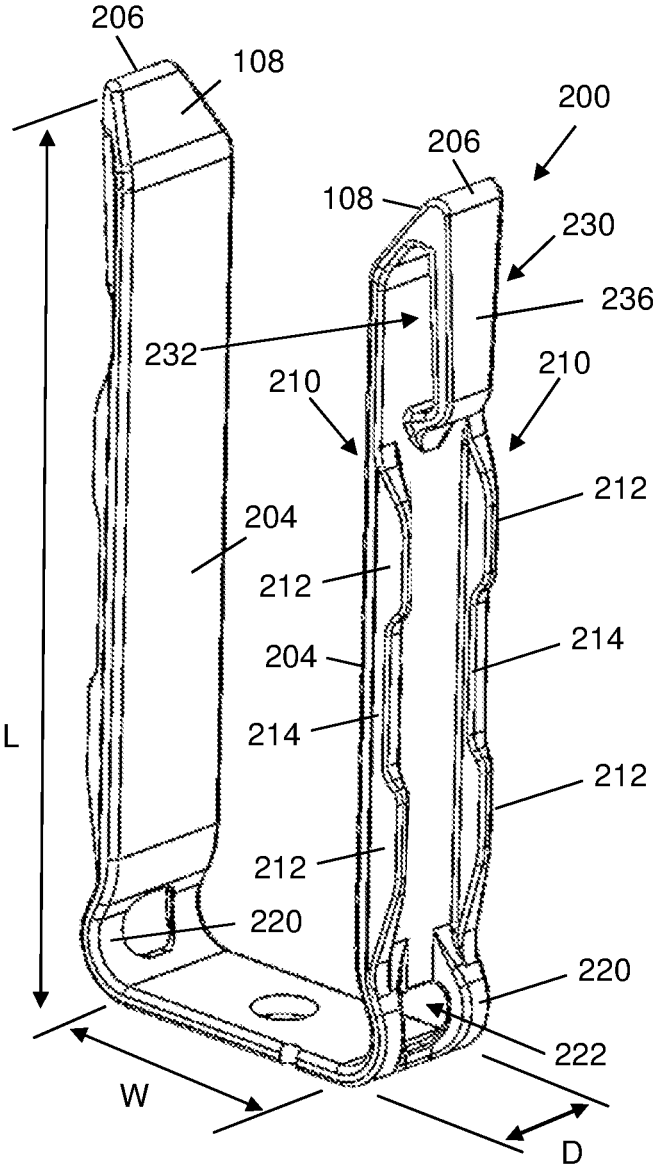
FIG. 3D is a perspective view of the bracket of FIG. 3A.

FIG. 3D includes reference to each of a lateral width dimension W (side-to-side), a longitudinal length dimension L (top-to-bottom), and a depth dimension D (front-to-back). These relate to FIG. 3D, the bracket 200 thereof, and more generally to other drawings and structures thereof and their dimensions in respective relation to the W, L, and D dimensions of FIG. 3D by association in the assembled carrier devices illustrated or implied herein. To be clear, the base plate 202 has a width in the width dimension W to accommodate a pistol magazine, whereas the base plate 402 has a greater width in the width dimension to accommodate a rifle magazine. Thus, the dimensions referenced in FIG. 3D showing the bracket 200 of the carrier device 100 represent a mutually orthogonal dimension set that is used herein to refer to other carrier devices and their components.

Each lateral side member 204, along an exterior side thereof, has a pair of parallel ribs 210 extending longitudinally from proximal the base plate toward the terminal end thereof. The ribs 210 are spaced from each other in the width dimension in that one rib 210 extends along a front edge of the side member 204 and a second rib extends along a back edge of the side member 204. The ribs 210 rigidify the side members and provide guiding and retention of the binding member 120. The ribs 210 have alternating high portions 212 and low portions 214 to guide and stabilize the binding member 120 in a binding arrangement with portions of the binding member received in the low portions. Particularly in the binding arrangement of the drawings (FIG. 1C), the free ends 124 of the binding member 120 extending from the adjuster 126 are conveniently held in a space 218 (FIG. 3B), which extends between the ribs 210, under crossed portions of the adjustable loop portion of the binding member.

Figure 1B:
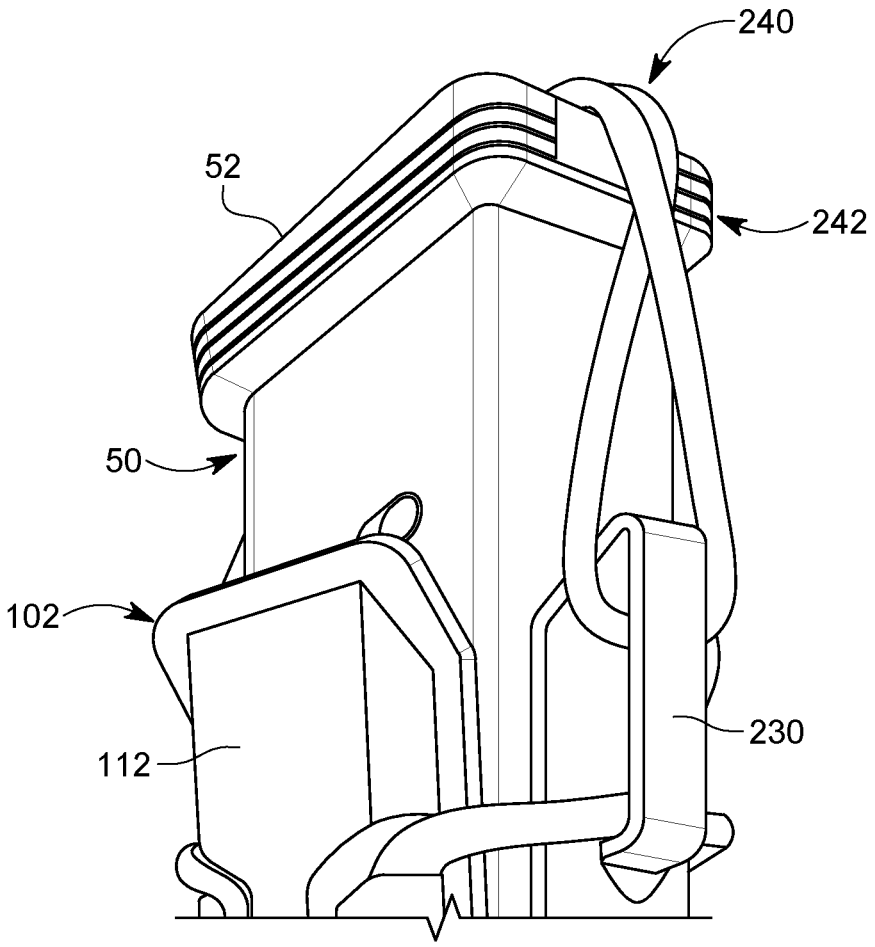
FIG. 1B is a perspective view of upper portions of the device and magazine of FIG. 1.

Each lateral side member 204 has a loop 230 surrounding and defining a through opening 232 for passage and retention of the binding member 120, for example as shown in FIG. 1. The upper tip of the loop 230 defines the above-described terminal end 206 of the side member 204, and an interior face of the loop defines the ramped inward contact surface 108. The laterally outward portion 236 of the loop 230 extends, longitudinally in the length dimension, generally parallel to longitudinally extending side member 204, thereby defining the opening 232 as an elongate slot having an internal length 238 (FIG. 3A).

The loop 230 and opening 232 thereof are dimensioned to receive multiple binding lines, for example as shown in FIG. 1A, in which the elongated opening 232 at each lateral side of the carrier device 100 advantageously accommodates both the binding member 120 and the retention member 240. In use, the retention member is passed over the floor plate end 52 of the magazine to further secure the inserted magazine in cooperation with the function of the binding member 120, which tightens the device 100 around the magazine to apply frictional engagement as already described. Twists 242 may be applied in the retention member 240 to further increase the force applied by the member 240, which pulls the magazine toward full insertion in the carrier device 100. A user can stretch and position the member 240 over the end 52 to secure the inserted magazine or pull the retention member 240 aside when the magazine is wanted for use or other removal.

Outer edges of the loop 230 and ribs 210 are generally beveled to minimize snagging or catching when carried with other gear. For example, thickness 228 of the loop, measured in the depth dimension, at the terminal end 206 is greater than the thickness 208 of lower portions of the side member 204, such that upper end of the side member overall tapers from the thickness 228 at the terminal end 206 to a uniform lower thickness 208. The tapering transition occurs along the ramped inward contact surface 108 such that the ramped inward contact surface 108 has the thickness 208 at the terminal end 206 and the thickness 228 at its base 248. The laterally outward portion 236 of the loop 230 also tapers from the thickness 208 at the terminal end 206 to a lesser thickness as it extends downward from the end 206.

The retention member 240 is illustrated as a stretchable cord, for example having one or more elastic strands forming a core covered in a woven fibrous sheath, for example made of polypropylene. Such binding members are known, for example, as shock cords and bungee cords. The retention member 240 may be formed as a continuous loop by fusing terminal ends of a length of such cod material, or may be knotted form a loop.

Figure 1C:
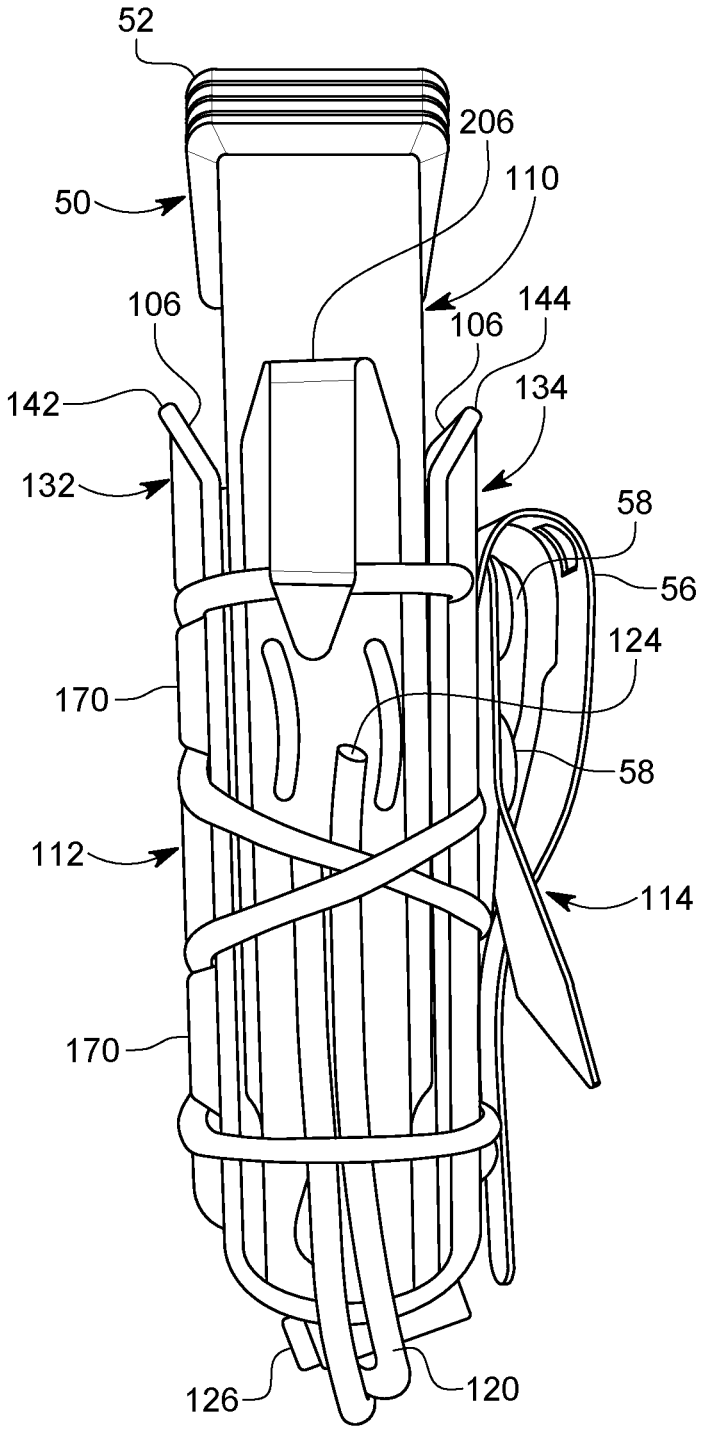
FIG. 1C is a side view of the device and magazine of FIG. 1 with a top retention member removed.

Each lateral side member 204, at its junction with the central base 202, has an arcuate laterally outwardly extending shoulder 220 in which a notch 222 is defined. The shoulders 220, in cooperation with proximal low portions of the ribs, guide and stabilize the binding member 120 in a binding arrangement, for example as shown in FIGS. 1A and 1C. Either notch 222 can further guide and stabilize the binding member 120 by receiving portions of the free ends 124 proximate the adjuster 126 according to which side of bracket 200 the free ends are placed in the space 218 (FIG. 3B) between ribs 210 and under crossed portions of the binder member 120 as exemplified in FIG. 1C.

In the binding arrangement of the drawings, the binding member 120 is retained by its passage through holes 162 in the second panel 134, openings 192 at the base plate 146 of the body member 130, and openings 232 of the loops 230 of the bracket 200. The binder member 120 also engages the hooks in both the first panel 132 and second panel 134. Advantageously, the engagement of the binding member 120 with the first panel 132 is by way of the first pair 194 and second pair 196 of hooks 170 without passing through any hole in the first panel 132. By this advantageous feature, the first panel 132 can be disengaged from the binding member 120 without necessitating delacing of the carrier device overall. Such disengagement can, for example, permit opening of the carrier device by hinging the first panel 132 relative to the second panel 134 by flexure of the strip portions 140 of the base section 136 as a living hinge. By such disengagement, the carrier device 100 can be effectively opened for inspection, clearing, or cleaning. Re-engagement can be achieved by re-hooking the binding member 120 in any preferred binding arrangement. In the illustrated binding arrangement, a twist is introduced in the binding member 120 when engaging the third pair 198 of hooks 170 (FIG. 2A) to effect the crossed portions 121 illustrated in FIG. 1A. Low portions of the ribs in each of side members are positioned longitudinally in alignment with the third hooks to receive such crossed portions 121 conveniently.

Even where adjustment of the carrier device 100 is wanted without opening, use of the hooks 170, instead of holes, permit considerable convenience and ease in adjusting the binding member 120, avoids kinks, and facilitates tension uniformity along the serpentine path of the loop portion of the binding member 120 in any binding arrangement that utilizes the hooks. The hooks further serve to avoid full winding of the binding member 120 around the first panel 132 and second panel 134. The binding member 120 in the illustrated binding engagement with the hooks is sunken within the slots 180 and under the hooks 170 relative to the first exterior surface 112 and second exterior surface 114. This protects the binding member 120 from snagging, direct collision, or crushing along the first exterior surface 112 and second exterior surface 114, which are expected to be the front and back of the carrier device 100 in typical use and thus are expected to see the highest likelihood of contact and striking with other objects. The binding member 120, when taut, urges the lateral edges 152 of the first panel 132 toward the lateral edges 153 of the second panel 134 to maintain frictional engagement of the inward sides 133 and 135 with an inserted magazine or other carried article.

Retention of an inserted magazine 50 or other article, such as a tactical light, a knife, or other gear item is assured against unintended removal by the frictional engagement provided to the interior of the carrier device 100 by the taut binding member 120 that urges the edges of the first panel 132 and second panel 134 together. The semirigid panels and side members 204 of the bracket 200, cooperatively acting with the binding member 120 as a self-adjusting frame, prevent closure of the opening 110 to maintain access to the interior of the carrier device 100 and assure the carrier device, when empty, is ready to rapidly receive an article such as a magazine. This is beneficial over, for example, a soft-walled pouch surrounded by a cinching cord, which may collapse when emptied, and may gather at its opening to delay withdrawal of an enclosed magazine at a critical moment.

As shown in FIG. 1C, the terminal end 206 of each side member 204 extends beyond the terminal ends 142 and 144 of the body member 130, in the assembled carrier device, to better present the upper ends of the ramped inward contact surfaces 108 of the frame members and guide the magazine into the opening 110. This is advantageous in that the corresponding greater dimension of a typical magazine having a rectangular cross section as represented in FIG. 4 first engages the ramped inward contact surfaces 108 of the frame members 204 when entering the carrier device.

The magazine 50 particularly shown in FIG. 1 is for ammunition typically used in a semiautomatic handgun, and thus the carrier device 100 and its components of FIGS. 1A-5 can be described as suited for use with a pistol without limitation as to other uses. In other embodiments, a carrier device can be used for ammunition magazines typically used in a semiautomatic rifle.

Figure 6:
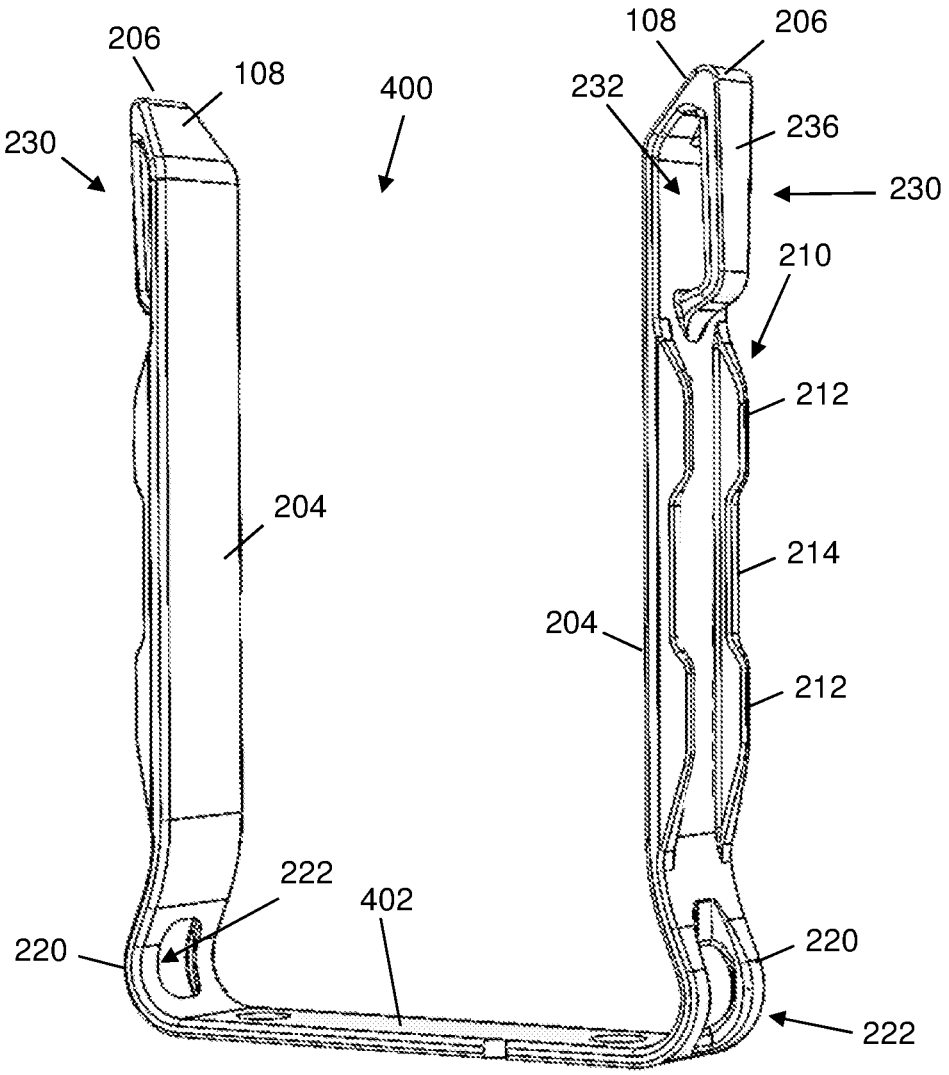
FIG. 6 is a perspective view of a bracket, according to another embodiment, for example for use in a carrier device for a rifle magazine.

The bracket 400 of FIG. 6 can be used, for example, in a carrier device for a rifle magazine. Descriptions above of the bracket 200 of the carrier device 100 apply as well to the bracket 400, as denoted by same reference numbers for same or similar features, differing by dimension or placement but providing same or similar function. The central base plate 402 of the bracket 400 is wider, as measured in the width dimension W (see FIG. 3D) than the base plate 202 of the bracket 200 to accommodate the corresponding greater width of a magazine loaded with rifle ordinance relative to a pistol magazine.

Figure 7A:
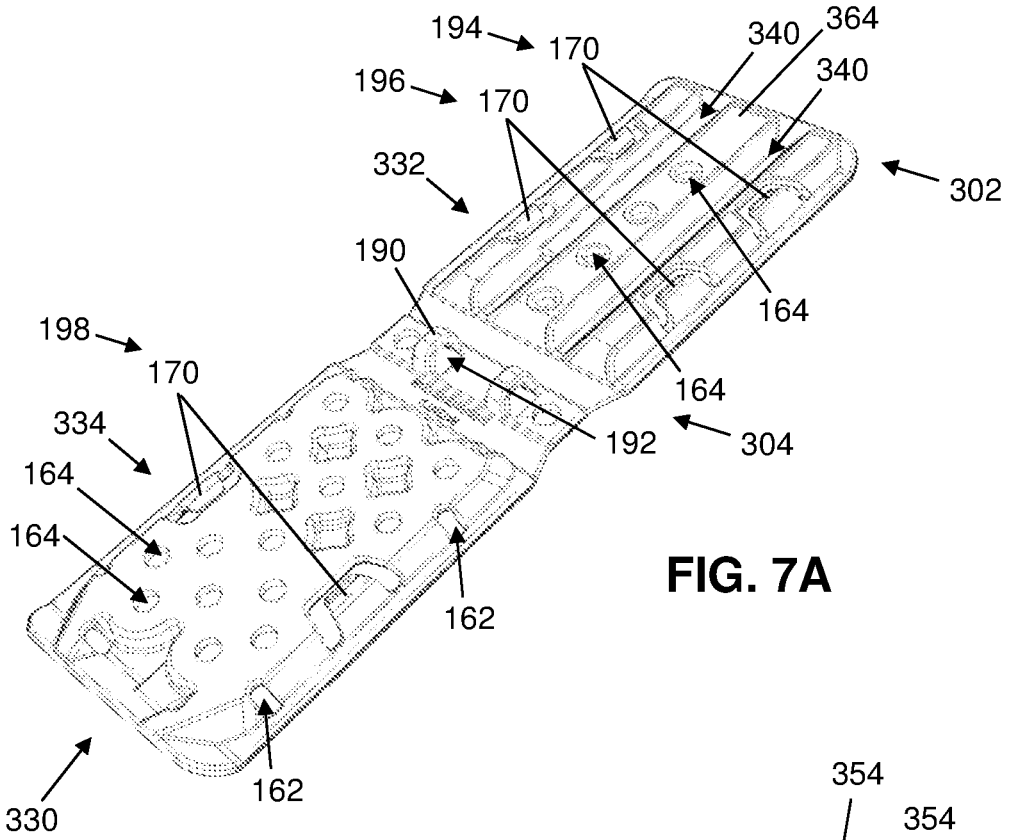
FIG. 7A is a perspective view of the outward side of an unfolded body member, according to at least one embodiment, for example for use in a carrier device with the bracket of FIG. 6.

A carrier device utilizing the bracket 400 is accordingly laterally wider, relative to the carrier device 100. The wider second panel 334 in FIG. 7A, relative to the second panel 134 of the carrier device 100, has more area and accordingly more mounting holes 164 through the outwardly planar portion of opposite its recess 356. As in the carrier device 100, the arrangement pattern of the holes 164 in the second panel 334 of the carrier device 300 matches hole patterns in accessories such as a mounting strap attached similarly as to the carrier device 100 in FIG. 1C.

The wider body member 330 of the carrier device, relative to the body member 130 of the carrier device 100, accommodates additional rigidifying features. The first panel 332 is further contoured by longitudinally extending inward grooves 340 (two in the illustrated embodiment) along the exterior surface (FIG. 7A), such that multiple (three in the illustrated embodiment) outward high portions are defined. A central high portion 364 has mounting holes 164 for attachment of or to other articles.

Figure 7B:
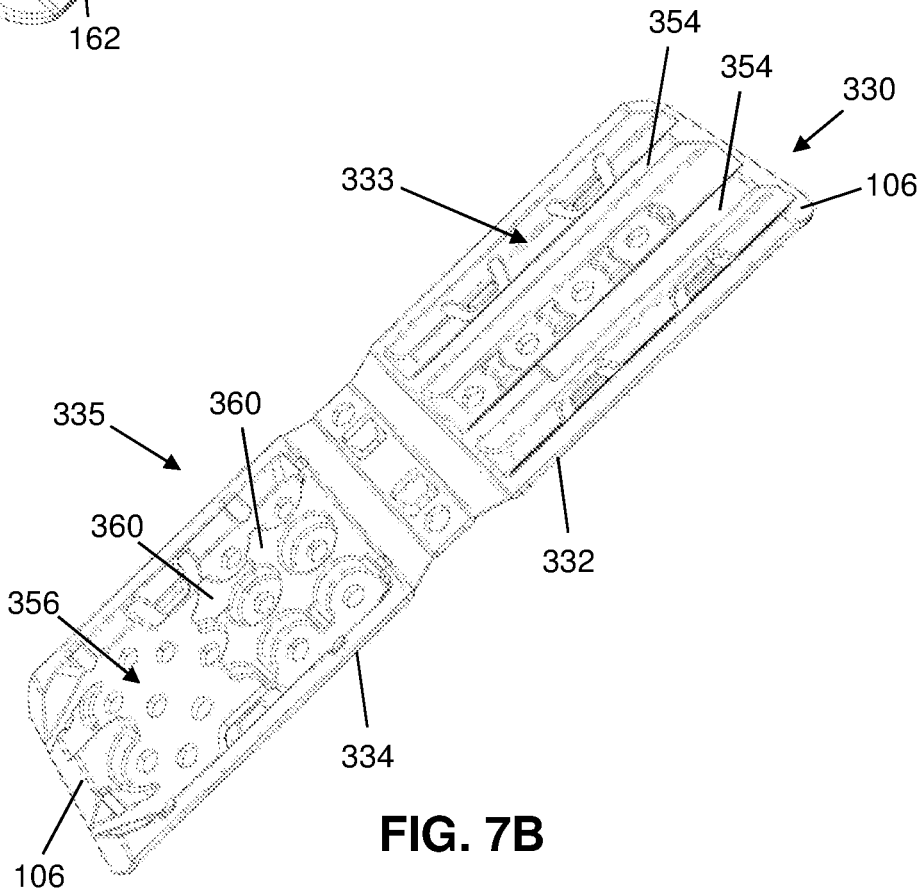
FIG. 7B is a perspective view of the inward side of the body member of FIG. 7A.

Longitudinal ridges 354 extend inward from the inward side 333 of the first panel 332 (FIG. 7B) materially opposite and corresponding to the inward grooves 340 along the exterior surface. These further add rigidity and provide frictional engagement with a magazine or other article within the carrier functionally similar to the ridges of the carrier device 100. The inward side 335 (FIG. 7B) of the second panel 334 has an inside recess 356 defined between its lateral edges, and several inward extending contact bosses 360 to provide further frictional engagement with a magazine or other article on an opposite side of the article relative to the ridges 354 of the first panel 332.

The first panel 332 has an opposing first pair 194 of hooks 170 proximal the first terminal end 302 and an opposing second pair 196 of hooks 170 proximal the second end 304 longitudinally spaced from the first pair. The second panel 334 has an opposing pair of hooks 170, referenced in the drawings as the third pair 198 rearwardly offset from, and longitudinally positioned between, the first pair 194 and second pair 196 in the assembled carrier device 300. The hooks 170 of the carrier device 300, in cooperation with the binding member 120, provide the same of similar function as those described above with reference to the carrier device 100 such the above descriptions apply as well to both carrier devices.

The above-described body members and brackets, and similar embodiments within the scope of these descriptions and referenced drawings, can be injection molded of thermoset plastic that, when set, is durable, semi-rigid, and resilient to flexures. The above expressly described embodiments, and others within the scope of these descriptions and drawings, are advantageous over hard-shell carriers having fixed dimensions. By use of the brackets as described above, nested with a folded hard-shell body member and assembled with a binding member, hard-shell benefits as to protection of a carried article and a persistently open entry are provided with a degree of size flexibility and article retention by internal friction.

Figure 10A:
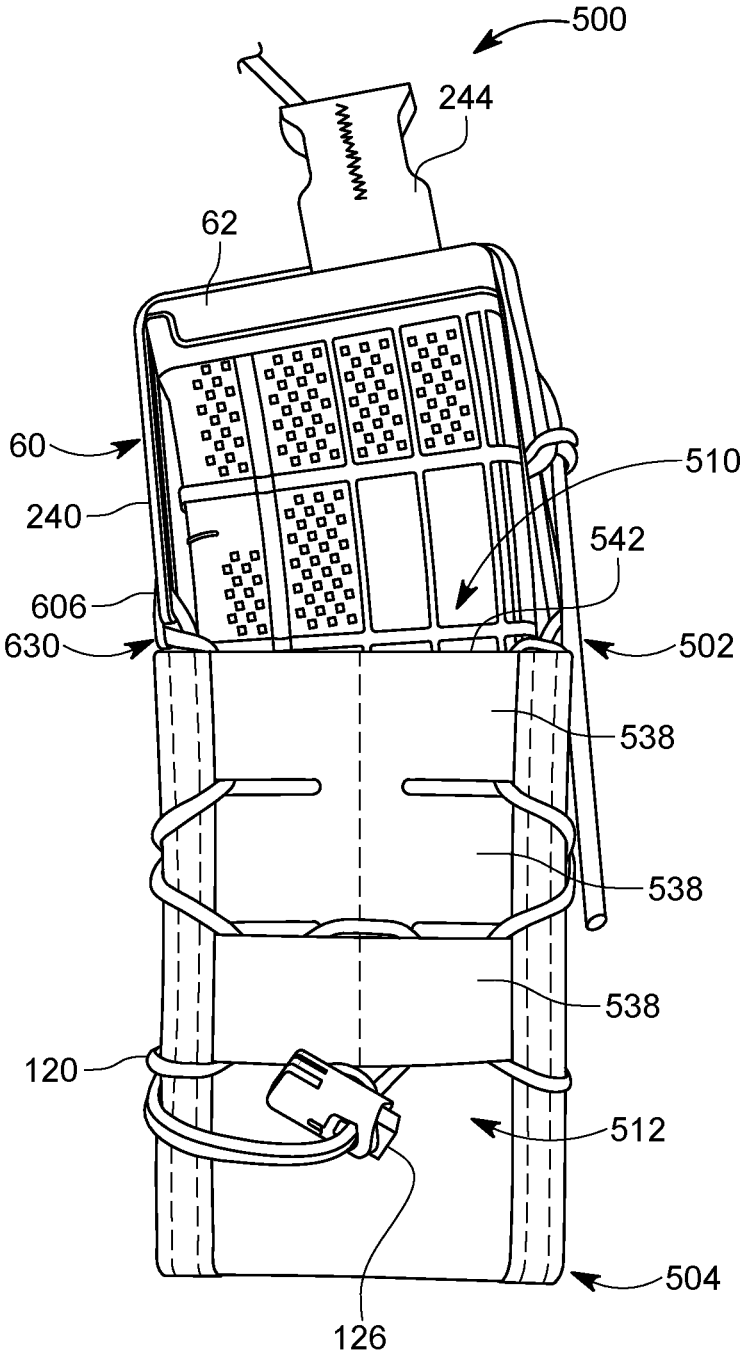
FIG. 10A is a front of a carrier device, according to at least one embodiment, incorporating the bracket of FIG. 8 and the body member of FIG. 9.
Figure 10B:
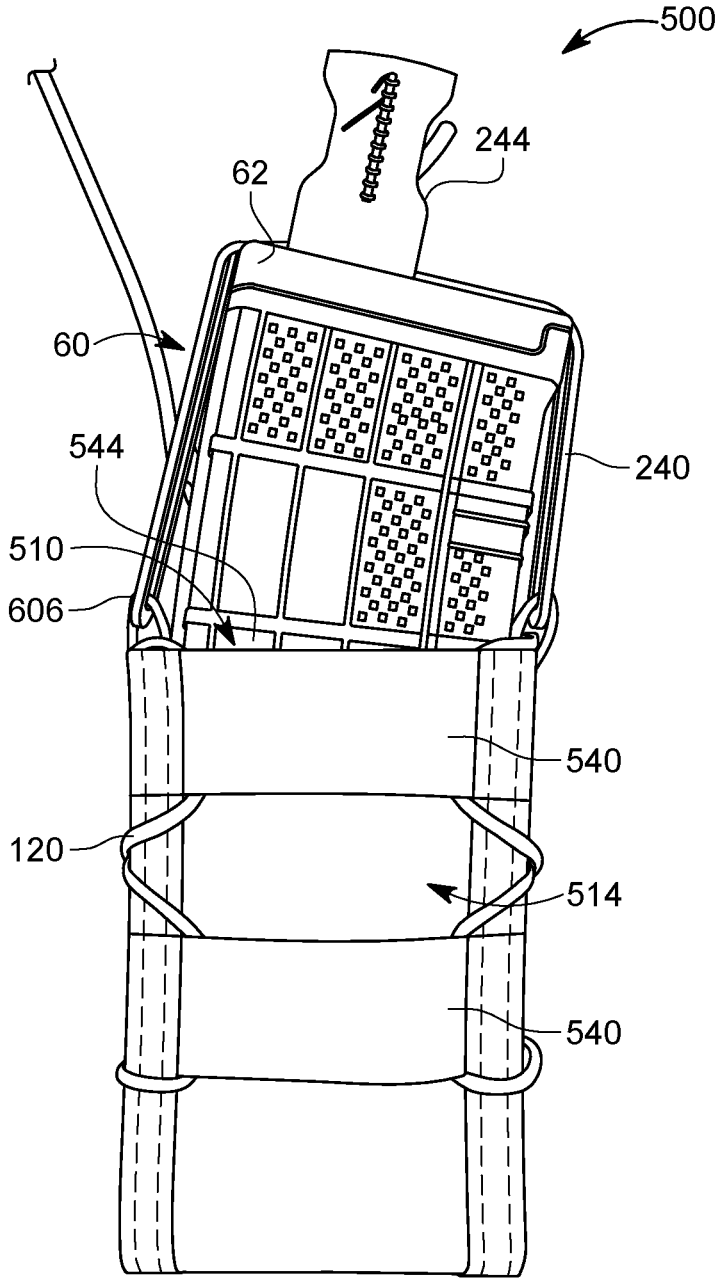
FIG. 10B is a back view of the carrier device and magazine of FIG. 10A.
Figure 10C:
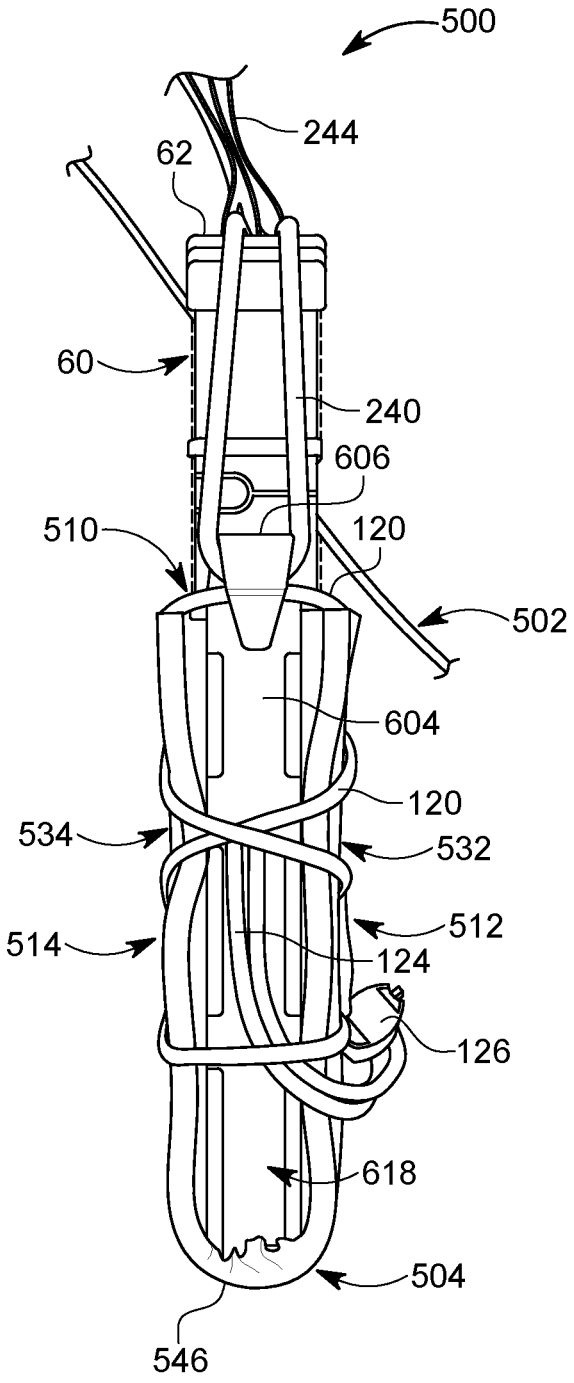
FIG. 10C is a side view of the carrier device and magazine of FIG. 9A.

In other embodiments, brackets are semi-rigid, and resilient, whereas the body members are made of, or include, fabric or other flexible or pliable material as in the carrier device 500 of FIGS. 10A-10C. By use of a semi-rigid and resilient bracket, pliable walls can be used while avoiding the shortcomings of prior-art soft-walled pouches that, for example, may collapse when emptied, and may gather where an opening is cinched by a shock cord. By use of the brackets as described below, a carrier device can offer the flexibility of a partially soft-walled pouch having an entry held open by the resilient spring-like function of an approximately U-shaped bracket as described below. The below expressly described embodiments, and others within the scope of these descriptions and drawings, further benefit from the ramped-contact surfaces at the terminal ends of the side members of the U-shaped brackets that guide the entry of a magazine or other inserted article.

Figure 8:
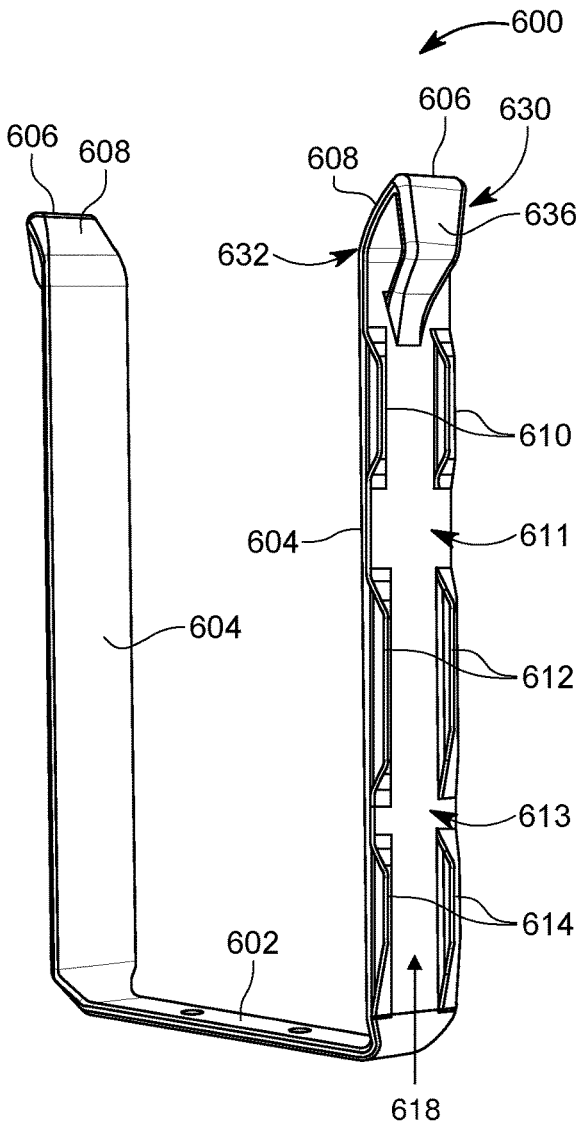
FIG. 8 is a perspective view of a bracket, according to another embodiment, for example for use in a carrier device for a rifle magazine.

The bracket 600 of FIG. 8 can be used, for example, in a carrier device 500 for a rifle magazine 60 as shown in FIGS. 10A-10C. Opposite lateral side members of the assembled carrier device 500 are provided by the bracket 600. The bracket 600 includes a central base plate 602 and, attached to opposite respective lateral ends of the base plate, a first lateral side member 604 and a second lateral side member 604 that extend parallel to each other in a same direction from the base plate. In the assembled carrier device 500, the bracket 600 is nested within the body member 530 in the folded condition, with the exterior side of the base plate 602 of the bracket 600 abutting or proximate the interior side of the body member 530 at a central portion.

Respective terminal ends 606 of the side members 604, in cooperation with the terminal ends 542 and 544 of the body member 530, define the first end 502 of the assembled carrier device 500. A respective ramped inward contact surface 608 adjacent the terminal end 606 of each side member 604 of the bracket 600 defines a tapered opening 510 at the first end 502 of the assembled carrier device 500.

Each lateral side member 604, along its laterally outward face, has longitudinally spaced (in the length dimension) pairs of parallel ribs, referenced in FIG. 8 as a first pair of ribs 610 proximal the terminal end 606, a second pair of ribs 612 longitudinally spaced by a gap 611 from the first pair of ribs 610, and a third pair of ribs 614 longitudinally spaced by a gap 613 from the second pair of ribs 612 and proximal to the base plate 602 end of the side member 604. Each pair ribs of 610, 612, and 614 consists of two ribs that are spaced from each other front-to-back, in the width dimension, in that one rib of the pair extends along a front edge of the side member 604 and another rib of the pair extends along a back edge of the side member 604. Thus a central space 618 extends along the exterior of the side member 604 between the ribs, where, for example, free ends 124 (FIG. 10C) of the binding member 120 extending from the adjuster 126 can be conveniently held as in FIG. 10C.

The ribs 610, 612 and 614 rigidify the side members 604 and provide guiding and retention of the binding member 120. The ribs and gaps define alternating high portions (ribs) and low portions (gaps) to guide and stabilize the binding member 120 in a binding arrangement with portions of the binding member received in the gaps.

Each lateral side member 604 has a loop 630 surrounding and defining a hole 632 for passage and retention of the binding member 120, for example as shown in FIG. 10C. The upper tip of the loop 630 defines the terminal end 606 of the side member 604, and an interior face of the loop defines the ramped inward contact surface 608. The laterally outward portion 636 of the loop 630 extends generally along the exterior of the side member 604, thereby defining the hole 632 as an elongate slot. Outer edges of the loop 630 and ribs 610, 612, and 614 are generally beveled to minimize snagging or catching when carried with other gear.

The loop 630 and hole 632 thereof are dimensioned to receive multiple binding lines, for example as shown in FIG. 10C, in which the enlarged hole 632 at each lateral side of the carrier device 500 advantageously accommodates both the binding member 120 and the retention member 240. In use, the retention member 240 is passed over the floor plate end 62 of the magazine 60 to further secure the inserted magazine in cooperation with the function of the binding member 120, which tightens the device 600 around the magazine to apply frictional engagement as already described. A gripping tab 244 for manipulating the retention member 240 is shown in the illustrated embodiment of FIGS. 10A-10C. A user can stretch and position the member 240 over the end 62 of the magazine, for example by use of the gripping tab 244, to secure the inserted magazine or pull the retention member 240 aside when the magazine is wanted for use or other removal.

Figure 9:
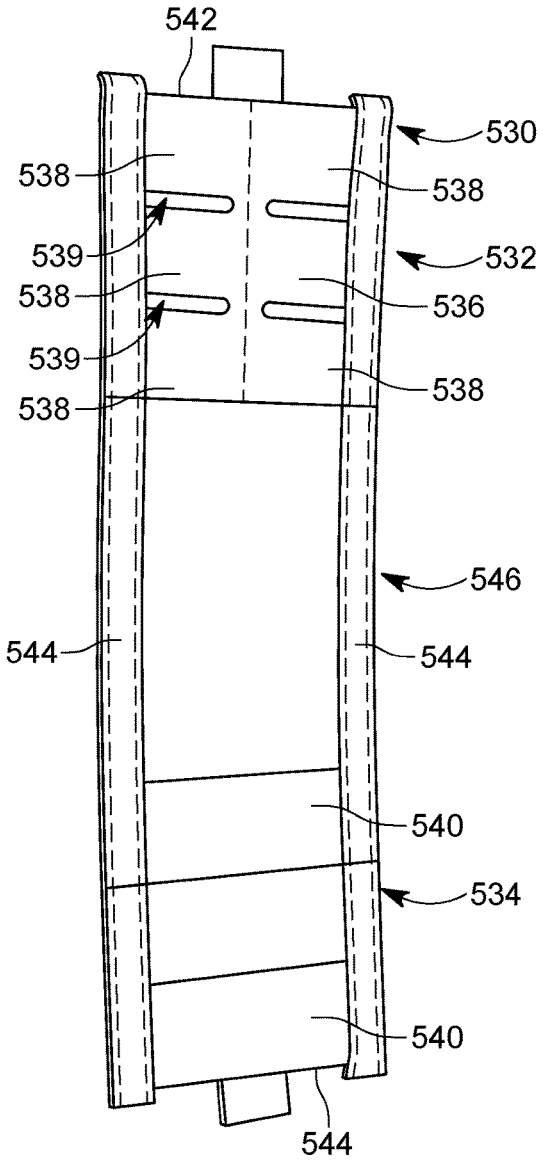
FIG. 9 is a plan view of an unfolded body member, according to at least one other embodiment, for example for use in a carrier device with the bracket of FIG. 8.

FIG. 9 shows an unfolded body member 530, according to at least one other embodiment, for example for use in the carrier device 500 of FIGS. 10A-10C with the bracket 600. In use as shown, a magazine 60 is inserted into an open first end 502 of the device 500. The open first end 502 may be for example oriented as upward in use. A second end 504 of the device, opposite the first end, is generally closed. At full insertion, a portion of the magazine 60 and the floor plate end 62 of the magazine extends outward from the first end 502 as available to be grasped and pulled from the carrier device 100.

An opening 510 (FIGS. 10A-10C) into the interior of the carrier device 500 is defined between the terminal ends 542 (FIG. 9, FIG. 10A) and 544 (FIG. 9, FIG. 10B) of the body member 530. Advantageously ramped inward contact surfaces 608 (FIG. 8) guide the magazine 60 into the opening 510 and thus into the interior of the carrier device 500. As shown in FIGS. 10A and 10B, the terminal end 606 of each side member 604, extends beyond the terminal ends 542 and 544 of the body member 530, in the assembled carrier device, to better present the upper ends of the ramped inward contact surfaces 508 and guide the magazine into the opening 510.

A first exterior side of the carrier device 500 may be generally directed outward when the carrier device is mounted on a host structure, and can thus be nominally termed the front side 512. (FIG. 10A). A second exterior side, opposite the front side 512, would be generally directed toward such a host structure, and can thus be nominally termed the back side 514. A mounting strap, for example attached to the back side 514, may be provided as an accessory for attaching the carrier device 500 to a host structure. Front and back are nominal terms referring to some expected uses of the carrier device 500 without limiting the carrier device in its construction or use.

Retention of the magazine 60 by the carrier device 500 against unintended removal, for example as a user or gear on which the device is mounted moves about, is assured by the elastically self-adjusting performance of the carrier device. A binding member 120 is stretched between the front side 512, and back side 514 of the device 500, crossing and capturing the lateral sides of the device 500 defined by the lateral side members 604 of the bracket 600. This adjustably circumferentially tightens the device around the magazine to maintain frictional engagement. This frictionally secures an inserted magazine while permitting sliding entry and removal of the magazine by force applied by hand at the outward extending end of the magazine.

The exterior front side 512 and opposite exterior back side 514 of the carrier device 500 in the illustrated embodiment are defined by the outer surfaces of corresponding sections of the single body member 530, which in the illustrated embodiment, is a flexible and foldable rectangular assembly having pliable components constructed of flexible pliable materials such as durable fabric and pliable band portions. The body member 530 is folded in the assembled device 500 (FIG. 10A). A first section 532 of the body member 530 defines the front side 512 of the assembled carrier device 500, and a second section 534 of the body member defines a back side 514 of the assembled carrier device 500. The sections 532 and 534 extend in opposite directions from a central section 546 of the body member 530 in the unfolded configuration of the body member 530 (FIG. 9). In the assembled carrier device 500 (FIG. 10C), the central section 546 is configured to form a one hundred and eighty degree turn as multiple bends, folds, or a U-turn or smooth arc as shown. This positions the sections 532 and 534 as generally parallel and extending in a same direction from the central section 546.

A sectioned member 536 of pliable material is mounted to the outward side of the first section 532, for example by stitching. The sectioned member 536 has multiple band portions 538 defined between slots 539, such that the band portions 538 act as loops to receive and retain respective portions of the binding member 120. Similarly, pliable bands 540 are mounted to the outward side of the second section 534, for example by stitching, such that the pliable bands 540 act as loops to receive and retain respective other portions of the binding member 120. Border strips 544 that strengthen outer lateral edges 542 of the body member 530 are attached to the main body section 532, for example by stitching. FIGS. 10A-10C show an exemplary binding arrangement for the binding member 120. Each user may utilize the illustrated arrangement or others according to usage and preferences that may vary.

Figure 11:
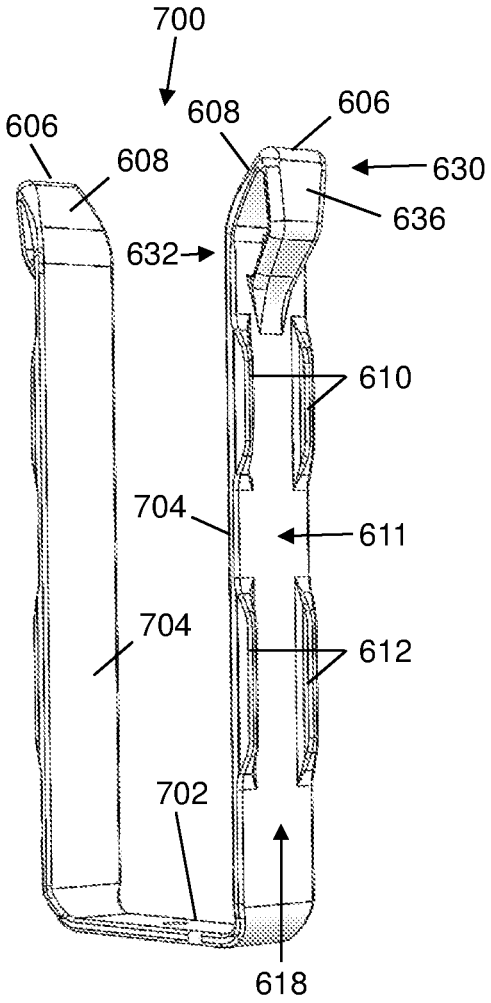
FIG. 11 is a perspective view of a bracket, according to another embodiment with similarities to that of FIG. 8, for example for use in a carrier device for a pistol magazine.

The bracket 700 of FIG. 11 can be used, for example, in a carrier device for a pistol magazine. Descriptions above of the bracket 600 of the carrier device 500 apply as well to the bracket 700, as denoted by same reference numbers for same or similar features, differing by dimension or placement but providing same or similar function. The central base plate 702 of the bracket 700 is not as wide (measured between the opposing side members 704 in the width dimension) as that of the bracket 600 (sized for a rifle magazine) to accommodate the corresponding lesser width of a magazine loaded with pistol ordinance. The lengths of the side members 704 (measured in the length dimension from the base plate 702 to the terminal ends 606) may vary from the lengths of the side members 604 according to magazine lengths and their bullet-count capacities. The bracket 700 can be assembled with a correspondingly dimensioned embodiment of the body member 530 to constitute, together with a binding member 120, a carrier device for a pistol magazine.

Figure 12:
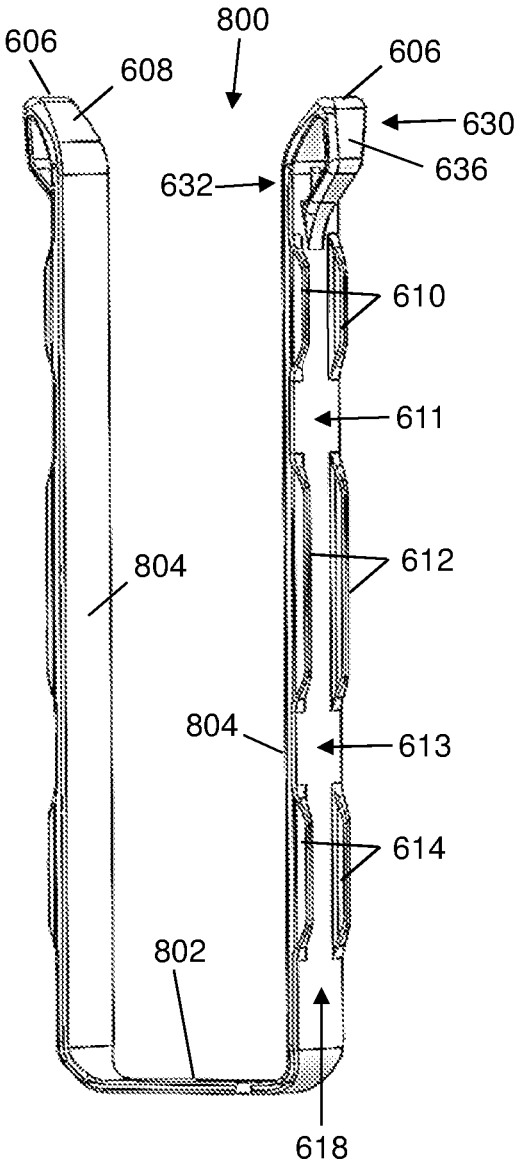
FIG. 12 is a perspective view of a bracket, according to another embodiment with similarities to that of FIG. 11, for example for use in a carrier device for a pistol magazine with extended capacity.

Similarly, the bracket 800 of FIG. 12 can be used, for example, in a carrier device for a pistol magazine with extended bullet-count capacity. Descriptions above of the bracket 600 of the carrier device 500 apply as well to the bracket 800, as denoted by same reference numbers for same or similar features, differing by dimension or placement but providing same or similar function. The central base plate 802 of the bracket 800 is not wide as that of the bracket 600 (FIG. 8) to accommodate the corresponding lesser width of a magazine loaded with pistol ordinance relative to a rifle magazine. The lengths of the side members 804 (measured in the length dimension from the base plate 802 to the terminal ends 606) are greater than those of the side members 704 (FIG. 11) to accommodate higher bullet-count capacity magazines. The bracket 800 can be assembled with a correspondingly dimensioned embodiment of the body member 530 to constitute, together with a binding member 120, a carrier device for a pistol magazine with extended bullet-count capacity.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A carrier device comprising:

a body member comprising a first section and a second section connected to and disposed a distance from the first section, the first section and second section each having a respective terminal end;

a bracket comprising a first lateral side member and a second lateral side member connected to and disposed a distance from the first lateral side member, a loop defining an opening at a terminal end of at least one of the first lateral side member and second lateral side member, wherein the bracket and body member nest such that an interior of the carrier device is defined between the first section and second section of the body member and between the first lateral side member and second lateral side member;

a binding cord engaging the first section and the second section, a portion of the binding cord disposed through the opening defined by the loop; and a retention cord for retaining a magazine when inserted into the carrier device, the retention cord having a portion disposed through the opening defined by the loop.

2. The carrier device of claim 1, the terminal end of each of the first lateral side member and second lateral side member are disposed in a plane above that passing through the terminal ends of the first and second sections.

3. The carrier device of claim 1, further comprising an opening disposed between and defined by the terminal ends of the lateral side members and first section and second section and wherein at least one of the terminal ends of the lateral side members comprise a ramped inward contact surface such that the opening into the interior of the carrier device is tapered.

4. The carrier device of claim 3, wherein at least one of the terminal ends of the first section and second section of the body member comprises a ramped inward contact surface.

5. The carrier device of claim 1, the body member comprises fabric.

6. The carrier device of claim 1, further comprising a mounting strap attached to at least one of the first section and the second section.

7. The carrier device of claim 1, wherein the retention cord includes a gripping tab secured thereto.

8. A carrier device comprising:

a body member comprising a first section and a second section connected to and disposed a distance from the first section, the first section and second section each having a respective terminal end;

a bracket comprising a first lateral side member and a second lateral side member connected to and disposed a distance from the first lateral side member, a loop defining an opening at a terminal end of at least one of the first lateral side member and second lateral side member, wherein the bracket and body member nest such that an interior of the carrier device is defined between the first section and second section of the body member and between the first lateral side member and second lateral side member;

a binding cord engaging the first section and the second section, a portion of the binding cord disposed through the opening defined by the loop; and a retention cord for retaining a magazine when inserted into the carrier device, the retention cord having a portion affixed to each of the first lateral side member and second lateral side member.

9. The carrier device of claim 8, the terminal end of each of the first lateral side member and second lateral side member are disposed in a plane above that passing through the terminal ends of the first and second sections.

10. The carrier device of claim 8, further comprising an opening disposed between and defined by the terminal ends of the lateral side members and first section and second section and wherein at least one of the terminal ends of the lateral side members comprise a ramped inward contact surface such that the opening into the interior of the carrier device is tapered.

11. The carrier device of claim 10, wherein at least one of the terminal ends of the first section and second section of the body member comprises a ramped inward contact surface.

12. The carrier device of claim 8, the body member comprises fabric.

13. The carrier device of claim 8, further comprising a mounting strap attached to at least one of the first section and the second section.

14. The carrier device of claim 8, wherein the retention cord includes a gripping tab secured thereto.

15. A carrier device comprising:

a body member comprising a first section and a second section connected to and disposed a distance from the first section, the first section and second section each having a respective terminal end;

a bracket comprising a first lateral side member and a second lateral side member connected to and disposed a distance from the first lateral side member, a loop defining an opening at a terminal end of at least one of the first lateral side member and second lateral side member, wherein the bracket and body member nest such that an interior of the carrier device is defined between the first section and second section of the body member and between the first lateral side member and second lateral side member;

a binding cord engaging the first section and the second section, a portion of the binding cord disposed through the opening defined by the loop; and wherein at least one of the first section and the second section comprises hooks for releasably engaging the binding cord.

16. The carrier device of claim 15, at least one of the first section and second section comprises a protrusion extending from the surface thereof into the interior of the carrier device.

17. The carrier device of claim 16, wherein at least one of the first section and second section comprise two protrusions disposed in parallel and having an inside channel disposed between the protrusions.

18. The carrier device of claim 15, wherein the at least a portion of the hooks include a tooth extending from a portion thereof for engaging the binding cord.

19. The carrier device of claim 15, further comprising a mounting strap attached to at least one of the first section and the second section.

20. The carrier device of claim 15, wherein the binding cord comprises a stretchable cord having an adjustable loop portion and an adjuster.

* * * * *